US010036243B2

(12) United States Patent
Schlembach et al.

(10) Patent No.: US 10,036,243 B2
(45) Date of Patent: Jul. 31, 2018

(54) LOW PROFILE MAGNETIC ORIENTING PROTECTORS

(71) Applicant: SHELL OIL COMPANY, Houston, TX (US)

(72) Inventors: Catherine Jean Schlembach, Houston, TX (US); Brian Kelly McCoy, Magnolia, TX (US)

(73) Assignee: SHELL OIL COMPANY, Houston, TX (US)

( * ) Notice: Subject to any disclaimer, the term of this patent is extended or adjusted under 35 U.S.C. 154(b) by 498 days.

(21) Appl. No.: 14/383,313

(22) PCT Filed: Mar. 5, 2013

(86) PCT No.: PCT/US2013/029012
§ 371 (c)(1),
(2) Date: Sep. 5, 2014

(87) PCT Pub. No.: WO2013/134201
PCT Pub. Date: Sep. 12, 2013

(65) Prior Publication Data

US 2015/0041117 A1 Feb. 12, 2015

Related U.S. Application Data

(60) Provisional application No. 61/608,447, filed on Mar. 8, 2012.

(51) Int. Cl.

| | |
|---|---|
| ***E21B 17/10*** | (2006.01) |
| ***E21B 17/20*** | (2006.01) |
| ***E21B 47/09*** | (2012.01) |
| ***E21B 47/12*** | (2012.01) |
| ***E21B 17/02*** | (2006.01) |

(52) U.S. Cl.
CPC ..... *E21B 47/123* (2013.01); *E21B 17/026* (2013.01); *E21B 17/1035* (2013.01); *E21B 17/1078* (2013.01); *E21B 17/206* (2013.01); *E21B 47/0905* (2013.01)

(58) Field of Classification Search
CPC ..... E21B 17/1035; E21B 17/206; E21B 47/0905; E21B 47/123
See application file for complete search history.

(56) References Cited

U.S. PATENT DOCUMENTS 3,704,749 A 12/1972 Estes et al.
6,131,658 A 10/2000 Minear
(Continued)

OTHER PUBLICATIONS

PCT International Search Report, Application No. PCT/US2013/029012 dated May 2, 2013.

*Primary Examiner* — David J Bagnell
*Assistant Examiner* — Brandon M Duck

(57) ABSTRACT

A system for providing information about a region of interest in a borehole, comprises a tubular passing through the region of interest, an optical fiber deployed on the outside of the tubular in the region of interest and optically connected to a light source and optical signal receiving means, at least one metal strip deployed on the outside of the tubular adjacent to the optical fiber, wherein the strip has at least one longitudinal face that is flat or concave so as to conform to the outside of the tubular, and means for holding the optical fiber and the metal strip in a fixed azimuthal location with respect to the tubular.

18 Claims, 1 Drawing Sheet

(56) References Cited

U.S. PATENT DOCUMENTS

| | | | | |
|---|---|---|---|---|
| 6,378,607 | B1 | 4/2002 | Ryan et al. | |
| 2004/0134658 | A1* | 7/2004 | Bell | E21B 43/116 166/297 |
| 2005/0236151 | A1 | 10/2005 | Gay et al. | |
| 2010/0066560 | A1* | 3/2010 | McDaniel | E21B 43/267 340/854.9 |
| 2011/0036566 | A1* | 2/2011 | Earles | E21B 17/1035 166/227 |
| 2011/0215234 | A1* | 9/2011 | Rose | E21B 47/1015 250/259 |

* cited by examiner

LOW PROFILE MAGNETIC ORIENTING PROTECTORS

PRIORITY CLAIM

The present application is a National Stage (§ 371) application of PCT/US2013/029012, filed Mar. 5, 2013, which claims the benefit of U.S. Provisional Application No. 61/608,447, filed Mar. 8, 2012, both of which are incorporated herein by reference.

FIELD OF THE INVENTION

The invention relates to a system and apparatus for deploying fiber optic sensors in a borehole without requiring expensive modifications to the drilling operation.

BACKGROUND OF THE INVENTION

The use of fiber optic (FO) sensors in downhole applications is increasing. In particular, optical fibers that can serve as distributed temperature sensors (DTS), distributed chemical sensors (DCS), or distributed acoustic sensors (DAS), and, if provided with Bragg gratings or the like, as discrete sensors capable of measuring various downhole parameters. In each case, light signals from a light source are transmitted into one end of the cable and are transmitted and through the cable. Signals that have passed through the cable are received at receiver and analyzed in microprocessor. The receiver may be at the same end of the cable as the light source, in which case the received signals have been reflected within the cable, or may be at the opposite end of the cable. In any case, the received signals contain information about the state of the cable along its length, which information can be processed to provide the afore-mentioned information about the environment in which the cable is located.

In cases where it is desired to obtain information about a borehole, an optical fiber must be positioned in the borehole. For example, it may be desirable to use DTS to assess the efficacy of individual perforations in the well. Because the optical fiber needs to be deployed along the length of the region of interest, which may be thousands of meters of borehole, it is practical to attach the cable to the outside of tubing that is placed in the hole. In many instances, the cable is attached to the outside of the casing, so that it is in close proximity with the borehole.

In some instances, a current practice for deployment of fiber optic sensor cables may entail the addition of one or more wire ropes that run parallel and adjacent to the fiber optic cable. Both the ropes and the cable may be secured to the outside of the tubing by clamps such as, for example clamps and protectors or with stainless steel bands and buckles and rigid centralizers. Such equipment is well known in the art and is available from, among others, Cannon Services Ltd. of Stafford, Tex. The wire ropes are preferably ferromagnetic (i.e. electromagnetically conductive), so that they can serve as markers for determining the azimuthal location of the optical fiber and subsequently orienting the perforating guns away from the fiber cable. These wire ropes may be on the order of 1 to 2 cm diameter so as to provide sufficient surface area and mass for the electromagnetic sensors to locate. Because of their size, the use of wire ropes can require costly "upsizing" of the wellbore in order to accommodate the added diameter. Besides necessitating a larger borehole, the wire ropes are susceptible to being pushed aside when run through tight spots or doglegs in the wellbore. Wire ropes that have been dislodged from their original position are less effective, both for locating the fiber optic cable and for protecting the optical cable from damage.

Hence it is desirable to provide a system for protecting and magnetically determining the azimuthal position of optical fiber deployed on the outside of a downhole tubular without requiring an expanded borehole.

SUMMARY OF THE INVENTION

Preferred embodiments of the invention provide a system for protecting and magnetically determining the azimuthal position of optical fiber deployed on the outside of a downhole tubular without requiring an expanded borehole. Specifically, preferred embodiments include a system for providing information about a region of interest in a borehole, comprising a tubular passing through the region of interest, an optical fiber deployed on the outside of the tubular in the region of interest and optically connected to a light source and optical signal receiving means, at least one metal strip deployed on the outside of the tubular adjacent to the optical fiber, wherein the strip has at least one longitudinal face that is flat or concave so as to conform to the outside of the tubular, and means for holding the optical fiber and the metal strip in a fixed azimuthal location with respect to the tubular. In some preferred embodiments, the strips are not magnetic, but are electrically conductive so that they will affect an electromagnetic flux signal from an orienting tool such as are known in the art and commercially available.

The tubular may be a casing, production tubing, cladding, coiled tubing, or the like. The metal strip(s) may have a rectangular, triangular, or trapezoidal cross-section and preferably has an aspect ratio greater than 1.25. The metal strips preferably comprise steel and have a smooth outer surface.

In some instances, the ferromagnetic strip may be provided on a spool.

As used in this specification and claims the following terms shall have the following meanings:

"casing" is used to refer to both casing and liner strings; and

"up," "down," "above," and "below" refer to positions that are relatively nearer or farther from the surface in a borehole.

BRIEF DESCRIPTION OF THE DRAWINGS

For a more detailed understanding of the invention, reference is made to the accompanying wherein.

DETAILED DESCRIPTION OF THE PREFERRED EMBODIMENTS

Figure 1:
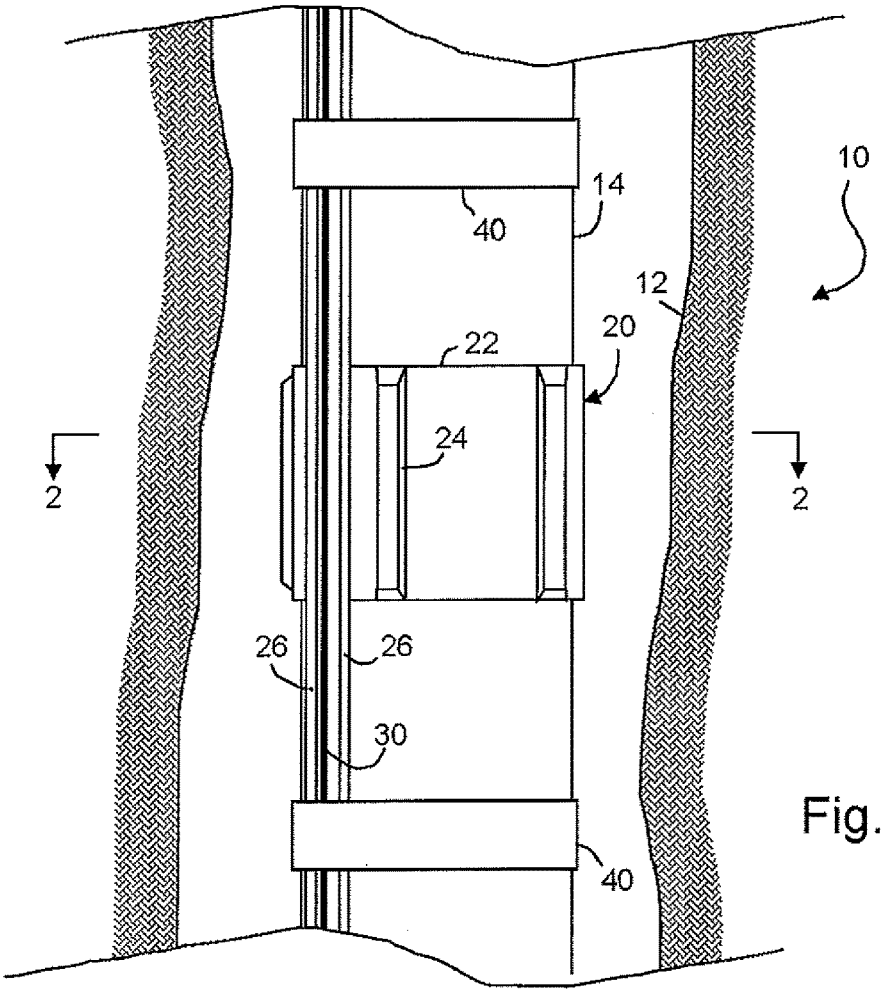
FIG. 1 is a schematic side view of a system in accordance with the present invention deployed in a borehole.
Figure 2:
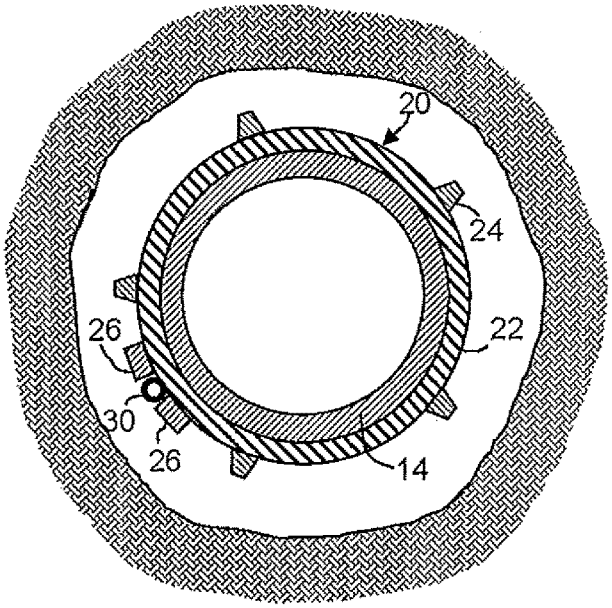
FIG. 2 is a cross-section taken along lines 2-2 of the FIG. 1.

Referring to FIGS. 1 and 2, a system 10 in accordance with one preferred embodiment is shown deployed in a borehole 12. System 10 includes a tubular 14 to which is clamped a fiber optic mount 20. Fiber optic mount 20 preferably includes a clamp 22, spacers or centralizer vanes 24, and at least one, and preferably two, metal strips 26. Strips 26 preferably extend along the full length of the tubing. A fiber optic cable 30 also extends along the tubular between strips 26, or, if there is only one strip, adjacent to the strip 26 and preferably between strip 26 and a spacer or centralizer vane 24.

Between mounts 20, it may be desirable to provide additional support for strips 26 and cable 30. In such cases, one or more spaced-apart clamping rings 40 may be applied around the tubular, cable, and strips. Clamping rings 40 may be half-shell clamps or other similarly-functioning devices, such as are known in the art.

Spacers or vanes 24 serve to maintain an annulus between the tubular and the borehole wall, so as to maintain a relative uniform and concentric cement sheath, prevent the fiber cable from abrading on the borehole wall while running, and mitigate pinching or damage to the fiber cable.

Tubular 14 may be casing, production tubing, cladding, coiled tubing, or the like. In any event, tubular 14 can be any tubular or other structure that is intended to remain in the hole for the duration of the measurement period. Depending on the setup, tubular 14 and the other components of system 10 may be cemented in place.

In order to serve as magnetic markers that effectively indicate the azimuthal location of fiber optic cable 30 metal strips 26 are preferably constructed of an electrically conductive or ferromagnetic material such as nickel, iron, cobalt, and alloys thereof, such as steel or stainless steels, and are preferably extruded or roll formed. Strips 26 preferably have sufficient mass to ensure they can be detected by an electromagnetic metal detector, such as are commercially available. The width and height of each strip can be optimized to reduce running clearance and while maintaining adequate metal mass to act as a magnetic marker.

Metal strips 26 may have a generally rectangular cross-section, as shown, and/or may have a concave inner surface that corresponds to the curvature of the outer surface of clamp 22.

Metal strips 26 are preferably positioned between a pair of adjacent spacers 24 and in some instances may be positioned adjacent to a selected spacer so as to derive mechanical protection from that spacer. Metal strips 26 are preferably spaced apart just enough to receive fiber optic cable 30 between them, as best illustrated in FIG. 2. In preferred embodiments, metal strips 26 have a thickness, measured radially with respect to tubular 14, that is at least as great as the diameter of fiber optic cable 30. In this configuration, strips 26 provide mechanical protection and positioning for cable 30, particularly during run in.

Strips 26 may be provided on spools and may be unspooled and applied to the outside of tubular 14 along with fiber optic cable 30 as the tubular is run into the hole. Metal strips 26 are preferably held in place on the outside of tubular 14 by means of clamps 40 and banding. In addition, if desired, strips 26 can be affixed to tubular 14 by adhesive.

When provided in the manner described above, strips 26 provide a low-profile system that replaces the wire rope system currently in use. The smaller running diameter of the system reduces or eliminates the need to "upsize" the wellbore in order to accommodate fiber optic cables (and possibly electronic gauge systems). The smooth surface of the steel strip is less susceptable to drag in the wellbore than with wire rope, increasing the probability of successful deployments.

Thus, the advantages of the present system include:

Low profile, reduced running diameter that can be optimized to match size of FO cable;

Spoolable; can be stored and deployed on a wooden or metal spools similar to wire rope Solid metal, resists deformation under loading Formable; can be punched, drilled, or formed (bent) to provide special features for attachment points to clamps or for other devices.

Smooth surface; lower coefficient of friction when compared to wire ropes; less likely to drag in the wellbore While the advantages of the present invention have been described with reference to a the preferred embodiments, it will be understood that variations and modifications can be made thereto without departing from the scope of the invention, which is set out in the claims that follow.

The invention claimed is:

1. A system for providing information about a region of interest in a borehole, comprising:

a tubular passing through the region of interest;

an optical fiber deployed on the outside of the tubular in the region of interest and optically connected to a light source and optical signal receiving means;

two metal strips deployed on the outside of the tubular both adjacent to the optical fiber, wherein each said strip has at least one longitudinal face that is flat; and means for holding the optical fiber and the metal strips in a fixed azimuthal location with respect to the tubular, wherein the metal strips are constructed of an electrically conductive or ferromagnetic material and form a magnetic marker to indicate an azimuthal location of the fiber optic cable and wherein the two metal strips are spaced apart just enough to receive said fiber optic cable between them.

2. The system according to claim 1 wherein the tubular is selected from the group consisting of casing, production tubing, cladding, and coiled tubing.

3. The system according to claim 1 wherein the tubular is casing.

4. The system according to claim 1 wherein each metal strip has a rectangular cross-section.

5. The system according to claim 4 wherein each metal strip has an aspect ratio greater than 1.25.

6. The system according to claim 1 wherein each metal strip comprises steel.

7. The system according to claim 1 wherein each metal strip is provided on a spool.

8. The system according to claim 1 wherein each metal strip has a smooth outer surface.

9. The system according to claim 1 wherein said metal strips have a thickness, measured radially with respect to the tubular, that is at least as great as a diameter of the fiber optic cable.

10. The system according to claim 9 wherein the metal strips provide mechanical protection and positioning for the fiber optic cable.

11. The system according to claim 1 wherein said metal strips are constructed of nickel, iron, cobalt, or an alloy thereof.

12. A system for providing information about a region of interest in a borehole, comprising:

a tubular passing through the region of interest;

an optical fiber deployed on the outside of the tubular in the region of interest and optically connected to a light source and optical signal receiving means;

two metal strips deployed on the outside of the tubular both adjacent to the optical fiber, wherein each said strip has at least one longitudinal face that is concave so as to conform to the outside of the tubular; and means for holding the optical fiber and the metal strips in a fixed azimuthal location with respect to the tubular, wherein the metal strips are constructed of an electrically conductive or ferromagnetic material and form a magnetic marker to indicate an azimuthal location of the fiber optic cable and wherein the two metal strips are spaced apart just enough to receive said fiber optic cable between them.

13. The system according to claim 12 wherein the tubular is casing.

14. The system according to claim 12 wherein each metal strip comprises steel.

15. The system according to claim 12 wherein each metal strip is provided on a spool.

16. The system according to claim 12 wherein said metal strips have a thickness, measured radially with respect to the tubular, that is at least as great as a diameter of the fiber optic cable.

17. The system according to claim 16 wherein the metal strips provide mechanical protection and positioning for the fiber optic cable.

18. The system according to claim 12 wherein said metal strips are constructed of nickel, iron, cobalt, or an alloy thereof.

* * * * *